US009402432B2

(12) United States Patent
Dean

(10) Patent No.: US 9,402,432 B2
(45) Date of Patent: Aug. 2, 2016

(54) SUN PROTECTION DEVICE

(71) Applicant: Ronald E. Dean, Austin, TX (US)

(72) Inventor: Ronald E. Dean, Austin, TX (US)

( * ) Notice: Subject to any disclaimer, the term of this patent is extended or adjusted under 35 U.S.C. 154(b) by 261 days.

(21) Appl. No.: 13/894,180

(22) Filed: May 14, 2013

(65) Prior Publication Data

US 2013/0312156 A1 Nov. 28, 2013

Related U.S. Application Data

(60) Provisional application No. 61/650,034, filed on May 22, 2012, provisional application No. 61/712,901, filed on Oct. 12, 2012.

(51) Int. Cl.
*A42B 1/18* (2006.01)
*A42B 1/06* (2006.01)

(52) U.S. Cl.
CPC .. *A42B 1/18* (2013.01); *A42B 1/067* (2013.01)

(58) Field of Classification Search
CPC ..... A42B 1/067; A42B 1/18
See application file for complete search history.

(56) References Cited

U.S. PATENT DOCUMENTS 4,912,778 A * 4/1990 Daniels ..... A42B 3/285 2/416
5,046,195 A * 9/1991 Koritan ..... 2/172
5,081,717 A * 1/1992 Shedd et al. ..... 2/181.4
5,153,939 A * 10/1992 Howe et al. ..... 2/69
5,153,943 A * 10/1992 Clement ..... 2/418
5,161,259 A * 11/1992 Shorts ..... 2/172
5,161,260 A * 11/1992 Reynolds ..... 2/207
5,201,077 A * 4/1993 Dondlinger ..... 2/209.3
5,323,491 A * 6/1994 Barrett, Jr. ..... 2/207
5,355,535 A * 10/1994 Bruder ..... 2/172
D357,343 S * 4/1995 O'Neal et al. ..... D2/866
5,442,817 A * 8/1995 Miner ..... 2/195.1
5,448,778 A * 9/1995 Phillips ..... 2/172
5,493,735 A * 2/1996 Rice ..... 2/209.13
5,603,120 A * 2/1997 Gifford ..... A42B 3/105 2/172
5,617,584 A * 4/1997 Brennan ..... 2/206
5,655,225 A * 8/1997 Mathers ..... 2/172
5,669,074 A * 9/1997 Newman, Jr. ..... 2/172
5,669,075 A * 9/1997 Weeks ..... 2/172
5,685,017 A * 11/1997 Kraft ..... 2/171.1
5,694,648 A * 12/1997 Nucifora ..... 2/172
5,701,609 A * 12/1997 Bridges ..... 2/422
D392,090 S * 3/1998 Monkhouse et al. ..... D2/891
5,887,287 A * 3/1999 Potochnik ..... 2/209.13
5,950,241 A * 9/1999 Gomez ..... 2/172
5,950,888 A * 9/1999 Nolan-Brown ..... 224/172
6,021,525 A * 2/2000 Mertins ..... 2/172

(Continued)

*Primary Examiner* — Clinton T Ostrup
*Assistant Examiner* — Anne Kozak
(74) *Attorney, Agent, or Firm* — Law Offices of Mark L. Berrier

(57) ABSTRACT

A sun protection device including a frame and a drape attached to the frame, where at least a portion of the frame can be removably positioned between the crown and the sweatband of a hat. When the frame is positioned between the crown and sweatband of the hat, the drape hangs downward from the crown, thereby shading at least a portion of a wearer's neck. In one embodiment, the frame and the drape extend around at least one half (and preferably about two-thirds) of the circumference of the crown of the hat, allowing the drape to shade the wearer's neck and ears. The upper edge of the drape may be stitched or otherwise attached to the upper edge of the frame. The drape may be any suitable fabric, and is preferably capable of blocking at least a portion of the sun's UV rays.

6 Claims, 4 Drawing Sheets

(56) References Cited

U.S. PATENT DOCUMENTS

| | | | | | |
|---|---|---|---|---|---|
| 6,029,278 | A * | 2/2000 | Lopez | 2/209.13 |
| D421,675 | S * | 3/2000 | Phillips | D2/891 |
| 6,131,201 | A * | 10/2000 | Chu | 2/172 |
| 6,163,886 | A * | 12/2000 | Carter | 2/172 |
| 6,481,021 | B2 * | 11/2002 | Spell | 2/209.13 |
| D481,198 | S * | 10/2003 | McKnight | D2/871 |
| D490,969 | S * | 6/2004 | Kobayashi | D2/891 |
| 6,857,134 | B1 * | 2/2005 | Cowell | 2/209.13 |
| D509,046 | S * | 9/2005 | Patterson | D2/866 |
| 7,310,829 | B1 * | 12/2007 | Engel-Wilson et al. | 2/209.13 |
| D591,485 | S * | 5/2009 | Cho | D2/879 |
| D594,186 | S * | 6/2009 | Petty | D2/891 |
| 7,578,007 | B2 * | 8/2009 | McIntyre | 2/181.4 |
| 8,024,818 | B1 * | 9/2011 | Davenport | 2/172 |
| 8,209,781 | B2 * | 7/2012 | Krochmal | 2/422 |
| D703,417 | S * | 4/2014 | Benton | D2/881 |
| D717,024 | S * | 11/2014 | Hines et al. | D2/891 |
| D717,525 | S * | 11/2014 | Peterson et al. | D2/891 |
| 8,918,916 | B1 * | 12/2014 | Kang | 2/175.6 |
| 2004/0139530 | A1 * | 7/2004 | Yan | 2/209.13 |
| 2004/0244095 | A1 * | 12/2004 | Sonne et al. | 2/175.4 |
| 2006/0168708 | A1 * | 8/2006 | Moshier | A42B 1/062 2/175.6 |

* cited by examiner

SUN PROTECTION DEVICE

CROSS-REFERENCE TO RELATED APPLICATIONS

This application claims the benefit of U.S. Provisional Patent Application 61/650,034, filed May 22, 2012, and U.S. Provisional Patent Application 61/712,901, filed Oct. 12, 2012. All of the foregoing patent applications are incorporated by reference as if set forth herein in their entirety.

BACKGROUND

1. Field of the Invention

The invention relates generally to sun protection, and more particularly to a sun protection device which is attachable to a hat, where the device shades a person's head, neck and ears from the sun.

2. Related Art

People often wear hats to protect themselves from the sun. Many types of hats have brims that extend outward from the hat to shade the wearer's head and face. In some cases, the brim extends all the way around the hat, providing shade for not only the face, but also the ears and neck. In other cases, the brim extends only part-way around the hat and provides shade for only a part of the wearer's head. For example, one of the most popular types of hats—a baseball cap—has a brim that extends from the front of the cap and consequently only shades the wearer's face.

It is therefore apparent that a hat such as a baseball cap may not provide adequate protection from the sun, and may allow a wearer's ears and neck to become sunburned. Even hats that have brims which extend all the way around the hat may not provide adequate sun protection, as the wearer may hold his or her head in such a position that shade from the brim does not fall on the wearer's ears and neck. For instance, the wearer may be working in a garden and looking downward, so that the brim on the back of the hat extends upward to some degree.

One solution to this problem is a drape, or piece of fabric, that is attached to the sides and back of a hat. When the hat is placed on the wearer's head, the drape hangs down over the wearer's ears and neck, protecting them from the sun, even if the wearer tilts his or her head. The drape may also provide the benefit of shielding the wearer's ears and neck from insects. Hats with these types of drapes may have their own drawbacks, however. For example, hats with drapes may not be considered fashionable, and there are typically very few of these types of hats from which to choose. Still fewer have removable drapes. In some cases, a drape is attachable to a specific hat by a zipper, snaps, Velcro or other means which are provided specifically for the purpose of attaching the drape to the hat. In other cases, a drape is made to be attachable to various hats by clips or other means. All of these means for fastening drapes are referred to herein as "drape fasteners". Commonly, the drapes make the hats quite unattractive.

It would therefore be desirable to provide a sun protection device for use with various different types of hats that overcomes one or more of the problems described above.

SUMMARY OF THE INVENTION

This disclosure is directed to systems and methods for sun protection that solve one or more of the problems discussed above. In one particular embodiment, a sun protection device includes a frame and a drape attached to the frame, where at least a portion of the frame can be removably positioned between the crown and the sweatband of a hat. When the frame is positioned between the crown and sweatband of the hat, the drape hangs downward from the crown, thereby shading at least a portion of a wearer's neck. In one embodiment, the frame and the drape extend around at least one half (and preferably about two-thirds) of the circumference of the crown of the hat, allowing the drape to shade the wearer's neck and ears. In one embodiment, the upper edge of the drape is stitched to the upper edge of the frame. The drape may be any suitable fabric, and is preferably capable of blocking at least a portion of the sun's UV rays.

In one embodiment, the frame is an elongated piece of semi-rigid plastic that is sized to fit between the crown and sweatband of the hat. The frame may be, for example, approximately 0.023 inch thick, 0.5 inch high, and 13 inches long. The frame may have one or more slits or cut-outs in its lower edge to accommodate stitches between the crown and sweatband of the hat when the frame is positioned between the crown and sweatband of the hat. In one embodiment, the frame has a narrow middle portion and two wider end portions on opposite sides of the middle portion, so that when the end portions are positioned between the crown and sweatband of the hat, the middle portion extends between the end portions, but does not extend between the crown and sweatband of the hat, allowing the frame to fit adjustable-back hats. In an alternative embodiment, the middle portion may be wider, so that it extends upward above the end portions, thereby covering the opening in the back of the adjustable hat. The frame may have one or more non-slip surfaces which increase friction between the frame and either the crown or the sweatband, thereby maintaining the frame's position between the crown and the sweatband.

One alternative embodiment comprises a hat having a removable drape. In this embodiment, the frame is removably positioned between the crown of the hat and the sweatband of the hat. The drape is attached to the frame. The frame and the drape extend around at least one half (and preferably about two-thirds) of the circumference of the crown of the hat. The drape hangs downward from the crown, thereby shading at least a portion of a wearer's neck and/or ears.

Another alternative embodiment comprises a method for protecting a person from the sun. In this method, a hat having a crown a sweatband is provided. The hat has no drape fasteners that are designed specifically for the purposes of attaching a drape. A drape which is attached to a frame is also provided. At least a portion of the frame is positioned between the crown of the hat and the sweatband of the hat, so that the drape extends around a portion of the circumference of the crown of the hat and hangs downward from the crown. The hat with the attached drape can then be placed on a wearer's head, thereby shading at least a portion of the wearer's neck and/or ears. The method may also include removing the frame from between the crown and sweatband, thereby detaching the drape from the hat.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1A:
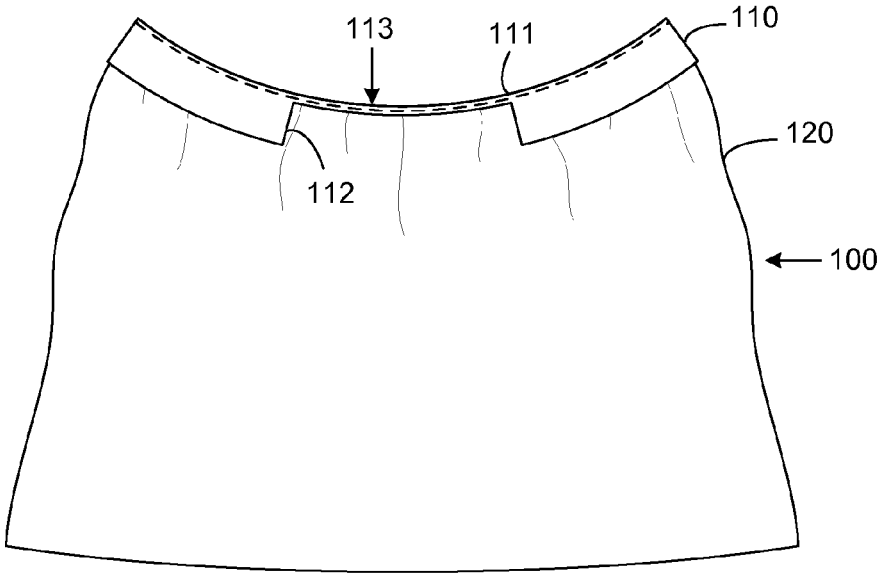
FIGS. 1A and 1B are illustrations of a sun protection device in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DESCRIPTION OF EXEMPLARY EMBODIMENTS

One or more embodiments of the invention are described below. It should be noted that these and any other embodiments described below are exemplary and are intended to be illustrative of the invention rather than limiting.

Exemplary embodiments of the invention described herein provide a means to attach a sun-protection drape to many different types of hats. The drape provides the benefits discussed above, but is attachable to and removable from virtually any hat without the need for special attachment means on the hat, such as snaps or hook-and-loop (Velcro) attachment points that are permanently sewn onto the hat.

Figure 1B:
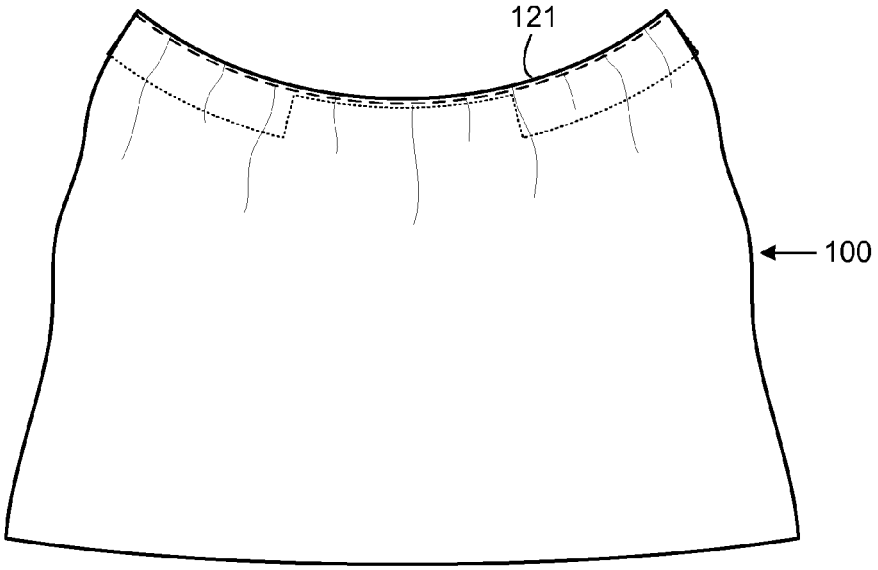

Referring to FIGS. 1A and 1B, an exemplary sun protection device 100 is shown. Device 100 includes a frame 110 and a drape 120. In this embodiment, an upper edge 121 of drape 120 is stitched to an upper edge 111 of frame 110, although it may be glued or attached by other means.

Frame 110 is semi-rigid. In other words, frame 110 is stiff enough to provide structural support to attached drape 120, but is flexible enough to allow it to be curved to conform to the contours of a hat. In one embodiment, the frame is made of a thin strip of a plastic such as high density polyethylene. In one embodiment, the strip of plastic is 0.01-0.05 inches thick, 0.5-2 inches high, and 10-16 inches long. (These ranges are intended to be exemplary, and some embodiments of the invention may have dimensions that fall outside these ranges.) Frame 110 may alternatively be made of belting or another material that is thin and flexible, yet stiff enough to support the drape.

Drape 120 is a piece of fabric that blocks at least a portion of the sun's harmful (e.g., ultraviolet, or UV) rays. The material of drape 120 may be selected to block all of these rays, or only a portion of the rays. The material may be formed of natural fibers, such as cotton, or synthetic fibers that may provide enhanced performance in blocking the sun's rays, faster drying, etc. In some embodiments, the material may be selected for other characteristics, such as the ability to absorb water for purposes of cooling the wearer, or the ability to shed water if the drape is intended to be used for protection against rain as well as sun. The drape may also be designed to provide protection from insects (e.g., it may be treated with insect repellant). In another alternative embodiment, the fabric may be fleece, microfleece, or other materials that are intended to keep the wearer's neck warm in cooler weather.

The design of drape 120 may vary, depending upon the needs or desires of the user. For instance, the specific shape of the drape may be longer or shorter to achieve a desired appearance. The material may be selected for its unobtrusiveness, or it may be selected to make a fashion statement. The drape could even consist of hair (as in a wig) so that the device could be used as part of a costume, rather than for sun protection. Because frame 110 supports drape 120 across its length, the fabric of the drape tends to lie flat on the back of the wearer's head and may provide an ideal location for an advertiser's logo, a sporting team's logo, or the like.

Figure 2A:
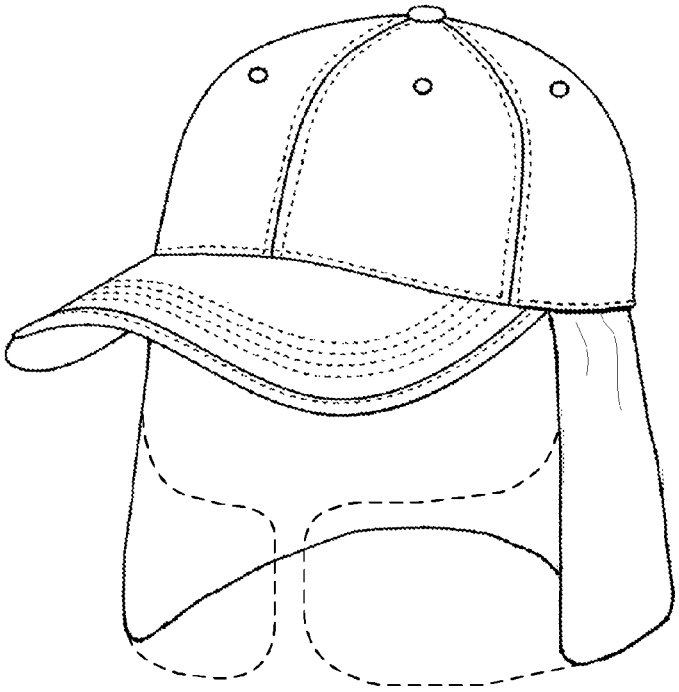
FIGS. 2A and 2B are illustrations of a sun protection device attached to a baseball cap in accordance with one embodiment.

In one embodiment, frame 110 is long enough to extend approximately ⅔ of the way around the wearer's head, so that attached drape 120 will cover the wearer's ears and neck. In the case of a baseball cap, frame 110 and drape 120 will extend along the portion of the cap's lower edge that does not have a brim (See FIGS. 2A and 2B). In one embodiment, the length of frame 120 is approximately 13 inches, but it may vary from one embodiment to another. In this embodiment, drape 120 is a rectangular piece of fabric approximately 11 inches high and 20 inches wide. The dimensions of the drape may also vary from one embodiment to another. As noted above, the upper edge of drape 120 is stitched to the upper edge of frame 110, so it is necessary in this embodiment to "bunch" the 20-inch fabric edge evenly along the 13-inch length of the frame. Bunching the fabric in this manner allows drape 120 to extend outward from the cap to more loosely cover the wearer's ears and neck. In an alternative embodiment, the drape may have extensions at the ends (see dashed lines in FIG. 2A) which can wrap around the front of the wearer's face and thereby provide protection for the wearer's face, as well as neck and ears.

Figure 3:
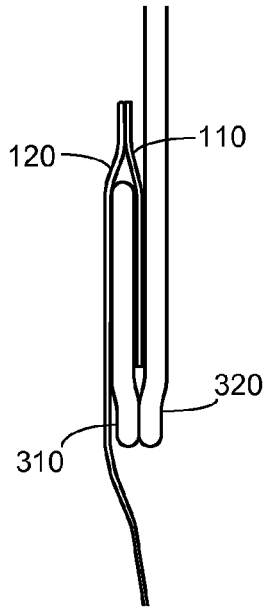
FIG. 3 is a diagram illustrating the manner in which the sun protection device is attached to a hat in accordance with one embodiment.

Referring to FIG. 3, a diagram illustrating the attachment of the sun protection device to a hat is shown. In this figure, it can be seen that the lower edge of a sweat band (or hat band) 310 of a hat is attached to the lower edge of the crown (outer portion) 320 of the hat. The lower portion of frame 110 is positioned in the space between sweat band 310 and crown 320. The stitched upper edge of frame 110 extends slightly above the upper edge of sweat band 310. Drape 120 hangs down from the upper edge of frame 110, extending downward beyond the bottom of the hat, so that it can cover the wearer's ears and neck. Preferably, frame 110 and drape 120 are sufficiently thin that they do not significantly affect the fit of the hat on the wearer's head.

Referring again to FIG. 1A, it can be seen that frame 110 is slightly curved. This causes the frame to be tilted inward slightly at the top when attached to a hat. This allows the frame to better conform to most hats, the crowns of which likewise taper inward at their bottom edges. It can also be seen in the figure that there is a notch 112 in frame 110. The notch allows the device to be attached to hats in which the sweat band does not extend all the way around the inside of the hat. For instance, many baseball caps are adjustable and their sweat bands do not extend across the adjustment band at the back of the cap (see, e.g., adjustment band 210 in FIG. 2B). Even if the sweat band in a hat extends all the way around the inside of a hat, the notched frame depicted in FIGS. 1A and 1B provide sufficient support in the center of the frame to prevent drape 120 from drooping below the bottom of the hat.

It should be noted that some hats have sweat bands that are attached (e.g., stitched) to the crown in several spots. The material of frame 110 is preferably thin enough that it can be easily trimmed (for instance, by cutting slits or notches in the frame) to avoid these spots, allowing the frame to be slipped between the sweat band and crown despite these stitched spots. Alternatively, various slits or notches may be pre-cut in the frame to allow it to be positioned between a sweat band and crown that are stitched together at various places.

Figure 2B:
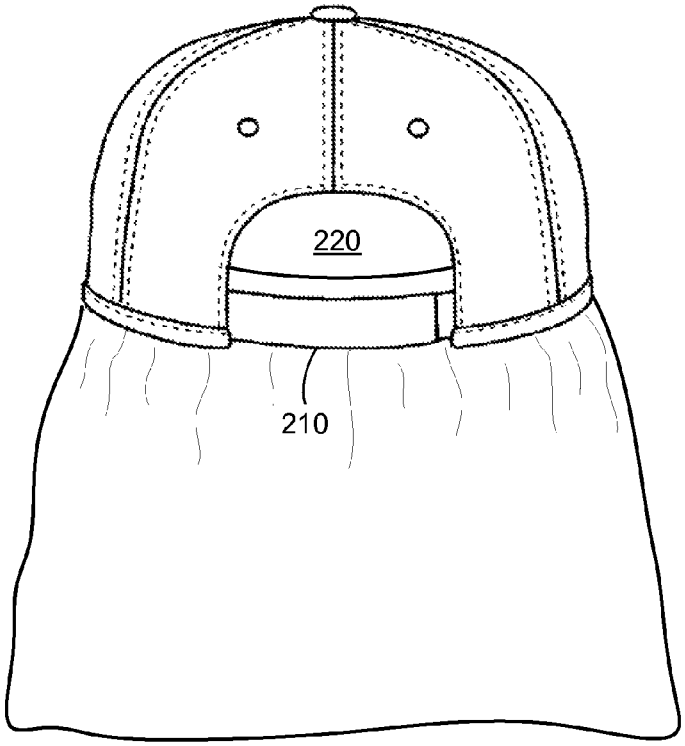
Figure 4:
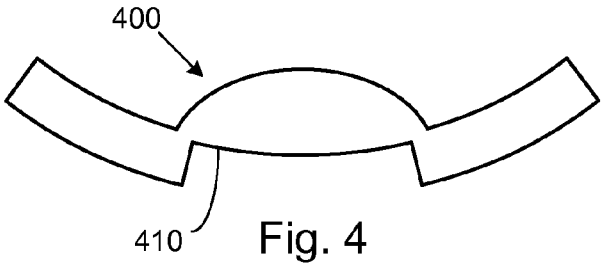
FIG. 4 is an illustration of an alternative frame design that provides an upper extension to cover an opening in an adjustable hat in accordance with one embodiment.

The frame may have other features as well. For example, while the embodiment depicted in FIGS. 1A, 1B and 2B, the frame goes straight across the center of the back of the hat. As shown in FIG. 2B, this may leave an exposed area (220) when the device is used with an adjustable hat. Referring to FIG. 4, an alternative frame design provides an upper extension 410 at the center of frame 400. Extension 410 extends upward to cover the portion of a wearer's head that would otherwise be exposed by the opening at the back of an adjustable hat. Conventionally, even hats with drapes may leave this portion of the wearer's head exposed, as shown in U.S. Pat. No. 5,355,535. The specific shape of the frame may vary in different embodiments.

Figure 5:
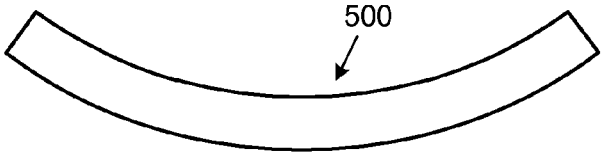
FIG. 5 is an illustration of an alternative frame design that in accordance with one embodiment.

Another alternative embodiment of the frame is illustrated in FIG. 5. In this figure, frame 500 is slightly curved, similar to the other frames, but it does not have a notch (e.g., 112 or 410) in the center of the frame. Because it does not include a notch, frame 500 may be more suitable for use with hats or caps that do not have an opening at the back (e.g., one-size-fits-all caps that stretch to fit the wearer's head, rather than having an adjustable band, such as band 210 in FIG. 2B). Frame 500 may be constructed using a thin sheet of plastic or other suitable material, and may be slit or otherwise trimmed to allow the frame to fit into the hat, despite stitches or other obstructions between the sweat band and crown of the hat. Although the frame consists of a single piece in the foregoing embodiments, an alternative embodiment may have multiple pieces. For example, the wider end-portions of the frame may be separate, so that the center portion of the drape is not attached to the frame, but is instead simply stretched between the two frame pieces.

Figure 6:
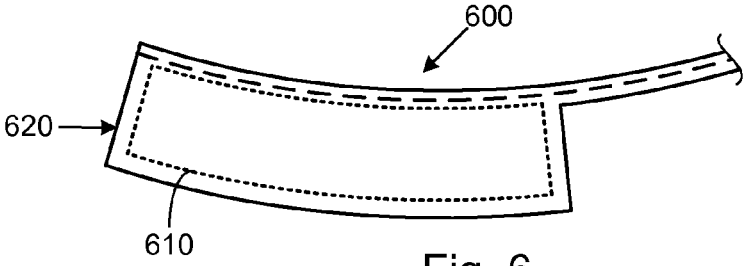
FIG. 6 is a diagram illustrating a non-slip surface on a frame in accordance with one embodiment.

Referring to FIG. 6, one side of a frame 600 is shown. In this embodiment, a non-slip surface 610 is provided on the lower portion 620 of frame 600. Non-slip surface 610 may be formed in a variety of ways, such as roughening the frame surface, applying a high-friction material to the frame or perforating the frame material in a manner that leaves small points on the surface (similar to a fine cheese grater). The non-slip surface may be formed on either side, or both sides, of frame 600 to help secure it in place between the sweat band and crown of a hat.

Figure 7:
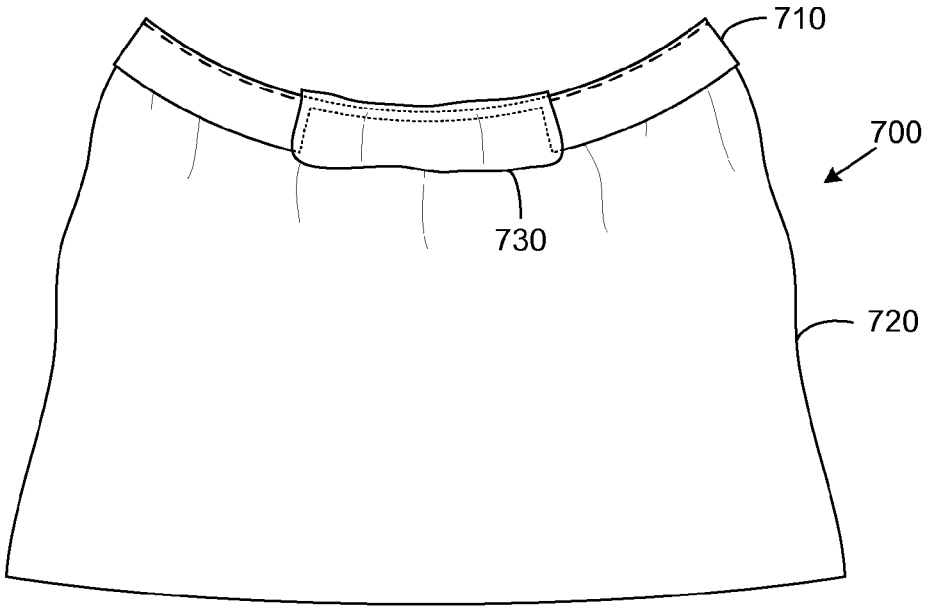
FIG. 7 is an illustration of a sun protection device in accordance with an alternative embodiment.

Referring to FIG. 7, another alternative embodiment is shown. In this embodiment, a sun protection device 700 has a frame 710 and a drape 720 attached to the frame. Since the device may be used with a hat that has an adjustment band (see FIG. 2B), the frame may be visible through the exposed area of the hat (e.g., 220). Because this may not be desirable, sun protection device 700 provides a small flap of fabric (730) which is attached to the top of frame 710 and folds over the frame to cover the portion of the frame that shows through the exposed area of the adjustable hat.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention.

What is claimed is:

1. A sun protection device comprising:

a hat having a crown and a sweatband on the interior of the crown and at a lower edge of the crown;

a frame, wherein at least a portion of the frame is removably positioned between the crown of the hat and the sweatband of the hat, thereby removably securing the entirety of the frame within the crown of the hat and above the lower edge of the crown of the hat; and a drape attached to the frame, wherein the frame extends from a first end of an upper edge of the drape to a second end of the upper edge of the drape and wherein the entire upper edge of the drape is supported by the frame;

wherein the frame and the drape extend around at least one half of the circumference of the crown of the hat; and wherein the drape hangs downward from the crown, the drape thereby being adapted to shade at least a portion of a wearer's neck;

wherein the frame comprises an elongated piece of plastic having a middle portion and two end portions on opposite sides of the middle portion, wherein when the end portions are positioned between the crown and sweatband of the hat, wherein at least a portion of an upper edge of the frame has a convex shape that extends upward above the end portions, thereby covering an opening in a back portion of the crown of the hat, wherein a lower edge of the frame has a cutout that extends across an adjustable portion of the sweatband below the opening in the back portion of the crown of the hat.

2. The sun protection device of claim 1, wherein the middle portion of the frame covers all of the opening in the back portion of the crown of the hat.

3. The sun protection device of claim 1, wherein an upper edge of the drape is stitched to an upper edge of the frame.

4. The sun protection device of claim 1, wherein the piece of semi-rigid plastic is between 0.5 inch and 2 inches high, between 0.01 inch and 0.05 inch high thick, and between 10 inches and 16 inches long.

5. The sun protection device of claim 1, wherein the drape comprises a fabric that is capable of blocking at least a portion of the sun's ultraviolet rays.

6. The sun protection device of claim 1, wherein the middle portion does not extend between the crown and sweatband of the hat.

* * * * *